United States Patent [19]

Koch

[11] Patent Number: 4,822,964

[45] Date of Patent: Apr. 18, 1989

[54] SPLIT HOUSING TIMER MECHANISM HAVING SEPARATING COVER WITH SNAP-LOCK FASTENER

[75] Inventor: Claude V. Koch, Two Rivers, Wis.

[73] Assignee: Paragon Electric Company, Inc., Two Rivers, Wis.

[21] Appl. No.: 114,456

[22] Filed: Oct. 29, 1987

[51] Int. Cl.[4] ..... H01H 9/02

[52] U.S. Cl. ..... 200/303; 200/38 R; 200/307

[58] Field of Search ..... 200/303, 307, 38 R; 220/307

[56] References Cited

U.S. PATENT DOCUMENTS

| | | | |
|---|---|---|---|
| 3,778,566 | 12/1973 | Gusaras | 200/307 |
| 4,212,415 | 7/1980 | Neely | 220/307 |
| 4,380,304 | 4/1983 | Anderson | 220/307 |
| 4,490,589 | 12/1984 | Voland | 200/38 R |

*Primary Examiner*—Renee S. Luebke

*Attorney, Agent, or Firm*—Foley & Lardner

[57] ABSTRACT

An electric timing device having a split housing for the timer and motor mechanism separated by a cover which has a plurality of snap fingers engaging complimentary recesses in each component of the split housings. The positioning and shape of the fingers and recesses prevents unintentional separation of the split housing components.

18 Claims, 3 Drawing Sheets

SPLIT HOUSING TIMER MECHANISM HAVING SEPARATING COVER WITH SNAP-LOCK FASTENER

BACKGROUND OF THE INVENTION

The present invention relates to split housings for an electrical device and, in particular, to split housings employing snap-lock fasteners for timer mechanisms.

Various types of devices are used to fasten together components of electrical apparatus. One type, often called a snap-lock fastener, usually has two or more, preferably three or more, flexible fingers spaced appropriately along the periphery of one of the components to be locked in place. The other component has complementary recesses adapted to receive the fingers. As the components are pushed together, the fingers enter the respective recesses. The fingers initially flex and then snap back into place as the components are nestled together. The components are locked in place by a projection on the free end of each finger which fits snugly in a space behind a catch projection located at the remote end of the recess.

In most electrical applications the fasteners employed are made of plastic material having good electrical insulating properties and flexing properties with requisite strength. The use of injection molding techniques is playing an important manufacturing role as snap-lock fingers are often molded integral with one component and the recess and catch integral with a second.

Examples of various types of snap-lock fasteners may be found in U.S. Pat. Nos. 3,514,554 issued to G. C. Boysen on May 26, 1970, 3,525,825 issued to K. C. Allison on Aug. 25, 1970, and 3,532,840 issued to W. R. Bauer on Oct. 6, 1970. Still other applications for such fasteners can be seen in U.S. Pat. Nos. 3,624,320 issued to Eberhart et al. on Nov. 30, 1971 and 3,866,008 issued to Angelo Toruzzi on Feb. 11, 1975. The manufacture of snap-lock fasteners through an injection molding process is taught in U.S. Pat. No. 4,045,637 issued to R. E. Mongeau on Aug. 30, 1977. Snap-lock fasteners have been used to secure together the split-housings of timer mechanisms as described in U.S. Pat. No. 4,491,710 issued to S. W. Smock on Jan. 1, 1985.

Timer mechanisms typically include electrical contact blades which make and break electrical contact in accordance with a rotational position of a cam. In some applications typified by the aforementioned U.S. Pat. No. 4,491,710, the contact blades, cam and associated components are in one housing while the motor and associated components are in a second housing. Electrical and mechanical communication is made through a separating cover when the housings are secured together. Generally, the contact blades extend through a side wall for appropriate electrical contact by the terminal or free end thereof with the apparatus being controlled.

The various electrical components of the prior art timers described above, particularly those employing split housings, while appropriately secured during normal use, are susceptible to a partial opening due to extraneous forces such as might be developed upon impact from a fall. This is particularly true if the impact occurs upon portions of the electrical components which necessarily protrude from the assembled device such as the free end of electrical contact blade and dials for the manual setting of the timer. The impact upon the free end of the blades can create a torque about the blade causing the undesirable flexing of an adjacent snap-lock fastener arm and permitting the housings and cover to partially separate. While the components may be pushed together to restore the assembly, the unintentionally partial opening provides ample opportunity in the interim for foreign objects to enter into the housings and cause damage to the components.

One solution has been to maintain the arms under tension in the engaged or locked position through structural design of the fastener. While initially minimizing unintentional opening of the housings, the constant tension often relaxes due to the creep characteristics of the plastic material and the fastener reverts to a largely untensioned state which, depending upon the application, can promote rather than prevent partial opening of the housings.

Another disadvantage of the prior art with respect to timer mechanisms are the large sizes and often complex configurations required by the motor housings. The peripheries of the housings generally must conform to each other to facilitate interaction of the fasteners and cooperative recesses. Thus, one of the housings must be constructed to be larger than necessary to enclose the components therein.

SUMMARY OF THE INVENTION

The present invention provides a particularly advantageous mechanism for securing split housings in an electrical device. A plurality of snap fingers are fixed to each side of an intermediate separating cover. Recesses appropriately positioned on the respective housings are adapted to receive and engage the fingers in a locked position. At least some of the recesses are structured to cause the fingers to bend in two directions upon entry to prevent unintentional partial withdrawal of the fingers. Additionally, through the use of a separating cover constructed in accordance with the present invention, individual housings of dissimilar shapes can be utilized. Thus the housings can be fabricated of a size to precisely encompass the components, allowing the manufacture of smaller and more compact electrical timing devices, thereby providing a savings in both materials and manufacturing costs.

BRIEF DESCRIPTION OF THE DRAWING

A preferred exemplary embodiment of the present invention will hereinafter be described wherein like numerals denote like elements and.

DETAILED DESCRIPTION OF A PREFERRED EXEMPLARY EMBODIMENT

Figure 1:
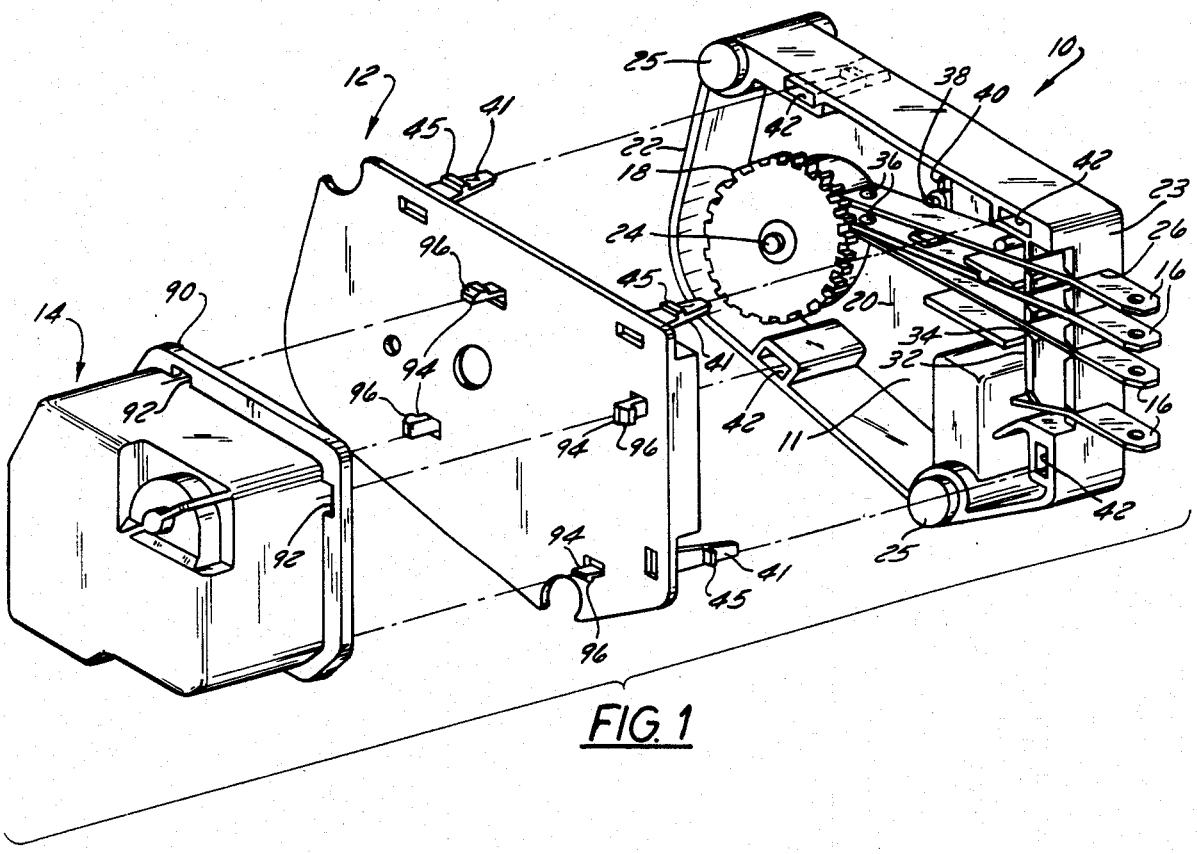
FIG. 1 is an exploded perspective of a timer device in accordance with the present invention wherein the outer wall of one recess is partially broken away, and for simplicity and clarity, with those specific details of the timer and motor mechanisms not necessary for a full and complete understanding of the invention omitted.
Figure 3:
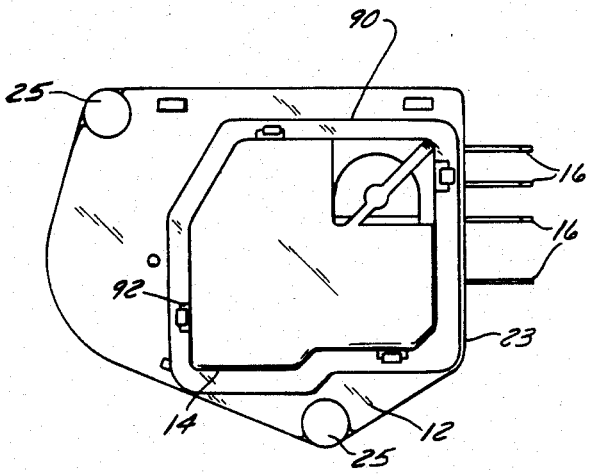
FIG. 3 is a top view from the motor housing side of the timer device shown in FIG. 2.
Figure 2:
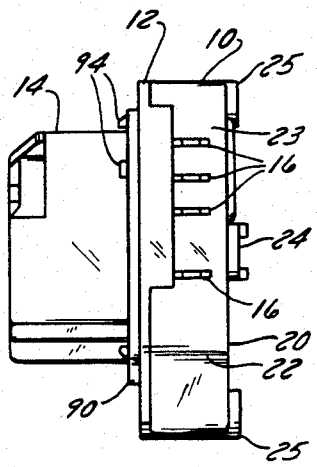
FIG. 2 is a side view of an assembled timer device.

Referring to FIGS. 1–3, the major components of the timer mechanism are timer housing 10, intermediate plate or separating cover 12, and motor housing 14. As will be described in greater detail below, cover 12 has a first group of fingers 41 extending perpendicularly from one surface and a second group of fingers 94 extending perpendicular from the opposite surface. Fingers 41 and 94 are suitably molded integrally with separating cover 12. When the timer is assembled, as seen in FIGS. 2 and 3, fingers 41 are received and locked in place within recesses 42 on timer housing 10 while fasteners 94 are received and locked in place within recesses 92 in a flange 90 circumscribing the periphery of motor housing 14.

Figure 4:
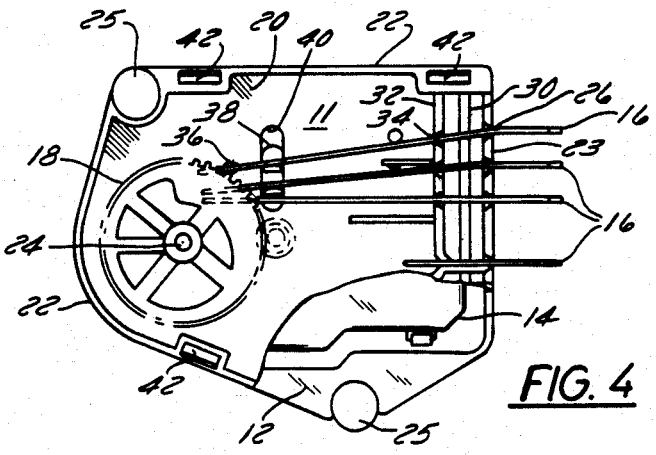
FIG. 4 is a plan view of the interior of the timer housing with various elements removed.

As may be seen in FIG. 1, housing 10 defines a generally piano-shaped interior cavity 11 to accommodate a plurality of contact blades 16 and a cam wheel 18. Piano-shaped cavity 11 is formed by a base 20 (best seen in FIG. 1) and a generally continuous side wall 22 disposed around the periphery of base 20. A cam wheel 18 fits within a curved region of wall 22 and is mounted upon an axle 24 journaled in base 20. Respective blades 16 fit within slots 26 of wall 22 along a straight portion 23 thereof. To prevent movement in the direction of the length of blades 16, each blade 16 is notched to fit over and receive a ridge 30 running parallel to wall portion 23. This feature is best seen in FIG. 4. A second wall 32 parallel to and positioned interior of ridge 30 is provided with additional slots 34 which receive blades 16. Walls 23 and 32 cooperate to prevent rotational movement of blades 16.

Molded integral to wall 22 are a pair of locating pins 25 positioned in essentially opposite corners. Locating pins 25 serve to facilitate registry of components for assembly and, in assembly, help maintain a fixed relationship between the assembled components.

The timing function of the timer mechanism is provided by selectively making or breaking electrical connection between respective blades 16. The internal end of blades 16, bearing electrical contacts 36, engages cam 18. A separating member 38 slides within a slide guide 40 molded into base 20 and has arms extending between blades 16. As cam 18 rotates, contacts 36, in response to the camming surface of cam 18 and the sliding movement of member 38 within guide 40, close and open in a predetermined sequential manner.

Recesses 42 are formed in housing 10 at various locations as can be best seen in FIG. 1. Two of the recesses 42 are closely adjacent to regions of walls 22 and 32 containing slots 26 and 34. Other recesses 42 are spaced along wall 22 near cam 18 and on the portion of wall 22 opposite thereto.

Separating cover 12 comprises a relatively flat plate 13 conforming in shape to the periphery of the larger of the two housings 10 and 14, which is illustrated here, as timer housing 10. Fingers 41, extending outwardly from one side of plate 12, are appropriately positioned for registry, when in assembly, with recesses 42. As will be explained, respective fingers 94 also extend outwardly from the opposite side of plate 12 and are appropriately positioned for registry with respective recesses 92 formed in flange 90 of housing 14. A tab 45 is formed as an extension from one face of each finger 41, intermediate the ends thereof. Tab 45 includes a side surface generally perpendicular to the arm face disposed at a predetermined distance from the surface of plate 12.

In assembly, fingers 41 are received in recesses 42 to secure housing 10 to cover 12. As is clearly seen in FIG. 5, each recess 42, a truncated wedge shaped volume, is defined by a position of the interior surface of wall 22, an interior wall 44 generally parallel to wall 22, and a pair of interior walls 43 extending between and perpendicular to walls 22 and 44 along the length of recess 42. The wedge shape provided by the general convergence of walls 43 toward base 20 permits a snug and complementary fit with the converging width of a respective finger 41 when housing 10 is secured to cover 12.

Figure 6A:
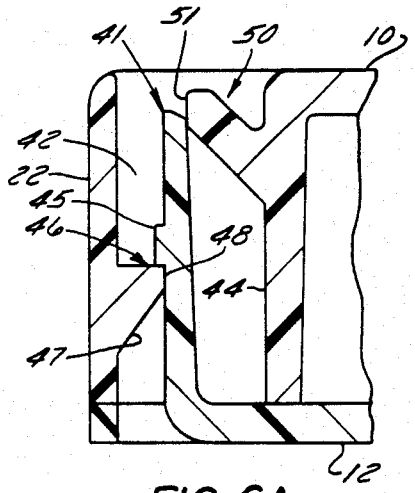
FIGS. 6A–6C show in side section the cooperative sequence between snap fingers and recess configuration occurring upon insertion of a finger in a recess in accordance with one embodiment of the present invention.
Figure 6B:
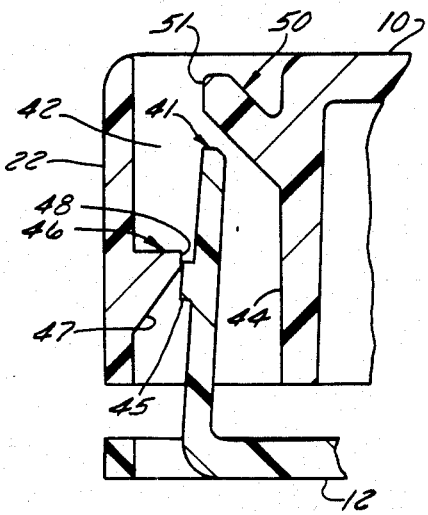
Figure 6C:
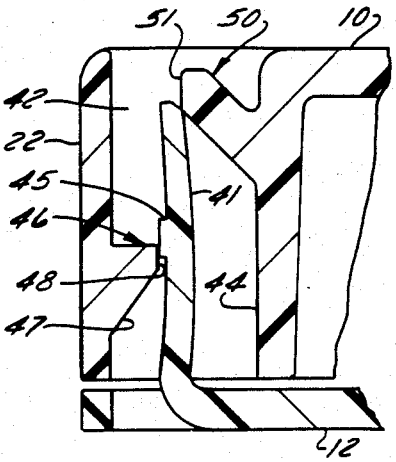
Figure 5:
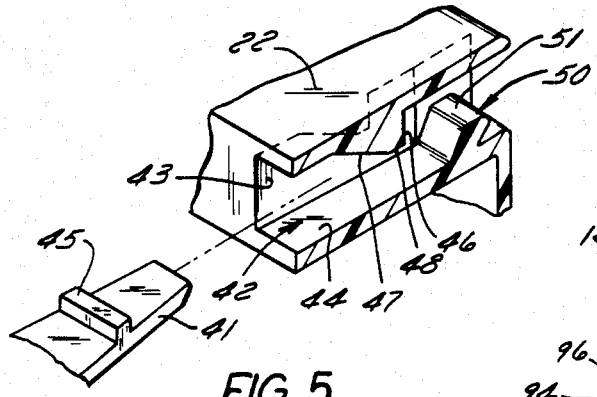
FIG. 5 is a perspective view with part of the side wall of the timer housing removed, showing the interior of a recess and a portion of a snap finger constructed in accordance with one embodiment of the present invention.

A catch member 46, shown in side section by FIGS. 6A–6C and in sectioned perspective by FIG. 5, is formed on the interior surface of wall 22 and projects into recess 42. Each member 46 has canted surface 47 and an abutting surface 48. A rib 50, suitably having an angled or cam surface 52 merging with an abutting surface 51, projects from wall 44 into recess 42. Member 46 and rib 50 are disposed in a predetermined relationship, i.e. separated by a predetermined transverse distance measured between planer extensions of their respective abutting surfaces 48 and 51. This distance is approximately equal to the thickness of finger 41.

When finger 41 is fully received in recess 42 and assumes a locked position (see FIG. 6A), the distal end of finger 41 engages surface 51 of rib 50 while the lower surface of tab 45 abuts the upper surface 49 of catch member 46. The engagement of the distal end of finger 41 with surface 51 tends to prevent the tab 45 from moving laterally within recess 42 and disengaging catch member 46.

To effect assembly, cover 12 is properly oriented to housing 10 with fingers 41 in registry with recesses 42. Housing 10 and cover 12 are forced into a closing relationship, causing each finger 41 to enter a respective recess 42. Initially, the midpoint tab 45 of finger 41 engages canted surface 47 and causes finger 41 to bend inwardly a slight amount from its axial (vertical, as illustrated) alignment. (See FIG. 6B). As finger 41 begins to contact surface 52 of rib 50, the portion of finger extending beyond the contact point with tab 45 is forced to bow slightly in a direction opposite to the aforementioned bending (see FIG. 6C). Projection 45 ultimately passes over catch 46, removing the opposing biases, and the under surface of tab 45 lodges against surface 49 of catch 46. Preferably, the distal end of finger 41 has disengaged from angled surface 52 of rib 50 and abuts surface 51 of rib 50 by the time tab 45 passes beyond catch 46, so that finger 41 springs back to an unbiased axial position, i.e., a position of minimal tension.

In the locked position, the otherwise free (distal) end of finger 41 is trapped in abutment against surfaces 48 of catch 46 and 51 of rib 50 since the thickness of finger 41 is approximately the same as the aforementioned horizontal gap between those surfaces. Extraneous forces, such as might be experienced upon impact if the timer mechanism were dropped, cannot cause separation of cover 12 from housing 10 as each finger 41 first must be bowed toward the interior of the mechanism, moved out of its abutting relationship with member 46 and rib 51, and then subjected to axial forces in order to separate cover 12 and housing 10. This sequence is an extremely unlikely occurrence as it requires two separate sequential forces per finger. Further, the orientation of the fingers and recesses is such that forces in different directions are necessary to bow the respective fingers 41.

Figure 7:
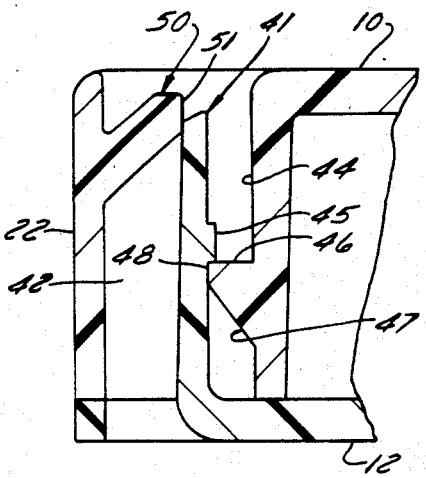
FIG. 7 depicts, in section, the structure of a snap finger and recess in accordance with another embodiment of the present invention.

Although the catch member 46 is described as extending into recess 42 from wall 22, the entire relationship and positioning could be reversed as shown in FIG. 7. Catch member 46 could extend from wall 44, and rib 50 extend from wall 22. The positioning of tab 45 would be reversed to cooperate with member 46. The fixed relationship of finger 41 between walls 22 and 44 and operative sequence remains the same as with the snap-lock mechanism described with respect to FIGS. 6A, 6B and 6C. By employing both the disposition of elements shown in FIGS. 6A–6C and the disposition illustrated in FIG. 7 for the respective fingers and tabs of a given cover 12 and housing 10, the various forces necessary to disassemble the components can still be controlled.

Figure 8B:
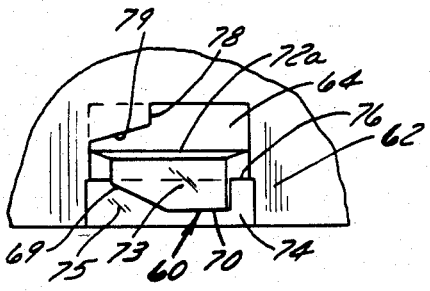
FIGS. 8A–8C depict various views of still another embodiment of the present invention.
Figure 8D:
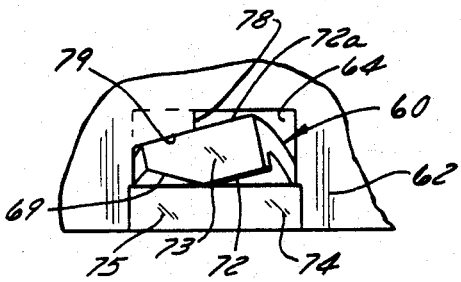
Figure 8C:
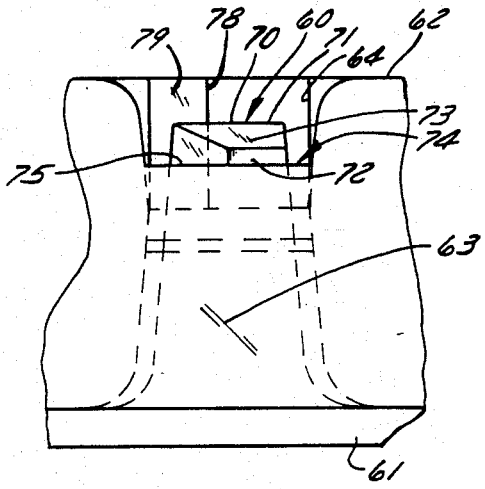
Figure 8A:
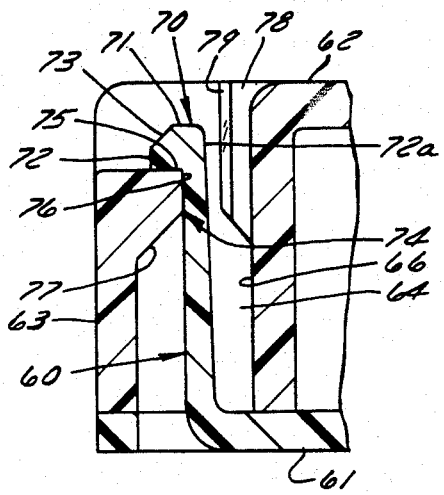

Referring now to FIGS. 8A–8C, another fastener embodiment in accordance with the present invention will be described. As seen in FIG. 8A, a cover 61 abuts a housing 62 when in an engaged or locked position. A fastener finger 60 is formed integral to a cover 61, and extends therefrom into, in assembly, a recess 64 formed in housing 62. A protuberance (head) 70, projecting away from housing 62, is provided at the distal end of finger 60. When engaged, head 70 abuts the top surface 75 of a catch member 74 formed within recess 64, on a wall opposing angled projection 78.

As best seen in FIG. 8C, the width of finger 60 narrows, i.e., converges toward head 70. Recess 64 is defined by inner surface 76 of wall 63, interior wall 66 (parallel to surface 65) and side walls 68 (phantom lines in FIG. 8C), converging concomittantly with finger 60 then flaring outwardly. Thus, recess 64 forms a truncated wedge volume adapted to receive finger 60 in a close fit relationship, a transverse (horizontal) top surface 71, opposing axial (vertical) surfaces 72 and **72*a*, and angled surface 73. From the top view of FIG. 8B, it can be noted that head 70 generally rectangular with a beveled portion 69 cut out, giving head 70** an overall wedge shape.

Catch member 74 projects into recess 64 from an inner surface 65 of wall 63 and has three surfaces; a transverse top surface 75, an axially disposed abutting surface 76, and a canted surface 77, the functions of which will be described below. Projection 78 is formed on wall 66 positioned across from and extending toward catch member 74. Projection 78 includes a surface 79 oriented at a slight angle to the plane of wall 66 and the axially disposed surfaces of 72 and **72*a* of fingers 60 and 76 of catch member 74. The bottom edge of surface 79 is axially disposed at a point corresponding to the intersection between surfaces 75 and 77 of member 74. Additionally, the width of head 70, i.e., distance between opposing axial surfaces 72 and 72*a* of finger 60, is slightly greater than the distance between abutting surface 76 of catch member 74 and surface 79 of projection 78**.

Assembly is initiated by closing cover 61 on housing 62, causing fingers 60 to enter corresponding recesses 64. Initially, canted surface 73 of head 70 engages similarly canted surface 77 of catch member 74 causing finger 60 to bend toward housing 62. As finger 60 rides over surface 77 and onto surface 76, finger 60 simultaneously engages angled surface 79 of projection 78, as seen in the perspective of FIG. 8C, a view of recess 64 with certain portions drawn in phantom lines. As finger 60 moves farther into recess 64, the bent finger 60, interacting with angled surface 79, forces finger 60 to twist essentially about its almost vertical axis, putting the finger under torsional tension. Since the width of head 70 is slightly greater than the distance between the facing surfaces 76 and 79, respectively of catch member 74 and projection 78, the beveled portion 69 of head 70 appropriately permits head 70 to twist in the confined space of recess 64. FIG. 8C illustrates finger 60 in its twisted position. Once head 70 clears catch 74, both the bending and torsional tensioning are released and finger 60 via head 70 and catch 74 are engaged in a locked position and finger 60 is in an untensioned state.

As can be appreciated, finger 60 cannot easily be disengaged once locked into position. Any extraneous forces to unlock cover 61 from housing 62 not only must bend finger 60 toward housing 62 but also must twist finger 60 to fit within the narrow and unusually designed cross-sectional configuration of recess 64. Without a specially designed tool to simultaneously release all fingers, the likelihood of experiencing accidental partial separation of cover 61 from housing 62 is remote.

Although FIGS. 8A–8C show catch member 74 on the interior surface 65 of wall 63 and projection 78 on interior wall 66, it should be understood that in some applications reversing the structure in a manner similar to the FIG. 7 embodiment may be desirable. This would also mean that head 70 of the finger 60 would extend toward the housing. The operative sequence would occur in a manner identical to that previously described.

In prior art mechanisms, securing the housings directly to each other required matching housing sizes and necessitated ordinarily the use of snap fingers of a longer type which are inherently more flexible and susceptible to extraneous forces, resulting in a propensity for withdrawal unless constructions set forth as previously described with respect to FIGS. 5–7 are employed. In accordance with the present invention, however, cover 12 is advantageously imbued with snap fingers on both sides to secure each housing 10 and 14 in a locking relationship therewith. Thus, housings of dissimilar configurations may be employed. As shown in FIG. 1, for example, motor housing 14 can be reduced in size and, by virtue of the smaller size, can accommodate snap fingers which are shorter and thus more rigid in structure as hereinafter described.

Figure 9:
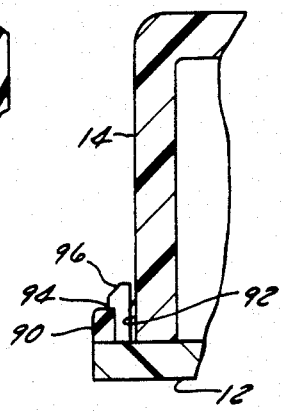
FIG. 9 illustrates, in side section, a snap fastener arrangement which may be used to fasten the motor housing to the cover.

Reference is now made to FIGS. 1 and 9 which illustrate the use of shorter snap fingers while the integrity of the timer device is advantageously maintained. Housing 14 is provided with flange 90 having a plurality of openings or recesses 92 herethrough adapted to receive the free ends of fingers 94 extending from cover 12. When in position, housing 14 is nestled against and locked to cover 12 along flange 90. Being smaller than housing 10, housing 14 can be positioned within the area defined by the line of contact of periphery housing 10 on the opposite side of cover 12. Fingers 94 may be constructed shorter than finger 60 because it is necessary for the head thereof only to clear the thickness of flange 90. The short length of fingers 94 results in the flexibility thereof to be considerably less, i.e., stiffer, than fingers 41. As best seen in FIG. 9, each of fingers 94 has a head 96 adapted to cam against the sidewall of recess 92 and snap over the top surface 91 of flange 90 once head 96 clears recess 92. The stiffness of fingers 94 holds flange 90 tightly against cover 22, thus providing a good seal against entry of foreign objects into the interior of motor housing 14, and provides improved stability and resistance against inadvertent opening due to falls and other mechanical shocks.

It should again be noted that fastener fingers 94 are located well within the area defined by a line drawn between fingers 41. This vividly illustrates the possible variations in sizes of the housings made possible by the unique structure of fastening fingers secured to both sides of cover 12.

In some applications, it may be desirable to use the snap-lock structures described in relationship to timer housing 10 with the motor housing 14. Thus, motor housing 14 would be provided with recesses extending along the exterior walls, rather than being formed in a flange thereof and, in many instances, have recess and finger structures identical to that described in relationship to housing 10. With this arrangement, the small size of housing 12 relative to housing 14 could be preserved while preventing inadvertent separation of the major components of the timer mechanism.

In summary, the use of a separating cover between two housings in an electrical device such as a timer mechanism structured in accordance with the present invention significantly reduces the required size of the motor housing to one suitable for enclosing the motor only. As noted from the prior art, the motor housing employed in split housing arrangements were often as large as the timing housing due to direct fastening of the housing to each other. By employing a cover with fastening fingers on each side thereof, the motor housing can be reduced significantly in size to encompass only the components housed therein. Additionally, the snap fingers and recesses are structured to prevent partial opening of the housings due to structural shocks as might occur in handling of the electrical device and thereby avoiding entry of objects and particles which could cause malfunctions during operation.

It will be understood that the foregoing description is of a preferred exemplary embodiment of the present invention and that the invention is not limited to the specific forms shown. Modifications may be made in the design and arrangement of the element within the scope of the present invention as expressed in the appended claims.

I claim:

1. An electrical device comprising a housing for housing electrical components and an enclosing member, said housing and enclosing member capable of being locked together in a locked position thereby preventing extraneous material from entering into said housing, one of said enclosing member or said housing having a plurality of fingers secured at one en thereto and free at the other end thereof, each of said fingers having a head near said free end, the other of said enclosing member or said housing having a plurality or recesses adapted to receive and engage respective fingers, said recesses including means for twisting said fingers along the length thereof and maintaining said fingers in a twisted configuration until said housing and enclosing member are in said locked position.

2. The device of claim 1 in which said fingers are essentially free of tension when said housing and enclosing member are in said locked position.

3. The device of claim 1 in which each of said fingers has a tab intermediate said fixed and free ends, each of said recesses being enclosed along one portion thereof defining an interior and exterior wall, one of said walls having a first projection extending toward and abutting said finger along a surface region of said finger between said tab and said base of said finger.

4. The device of claim 3 in which said other of said walls has a second projection with an angled wall providing a guide surface for said finger, said tab camming against said first projection upon entry of said finger in said recess and causing said finger to move against said angled wall and twist along its length until said housing and enclosing member are in said locked position.

5. An electrical timing device comprising:

(a) a first housing defining a cavity with a first open side and having a first set of catches spaced around said first open side;

(b) a second housing defining a cavity with a second open side and having a second set of catches spaced around said second open side; and (c) a substantially flat intermediate cover positioned between said first and second housings;

(d) a first set of fastener finger means fixed to one side on said cover extending outwardly therefrom for cooperating with said first set of catches and for securing said first housing into an abutting and locked position with said one side of said cover thereby causing said first open side to be enclosed by said one side of said cover; and (e) a second set of fastener finger means fixed to the other side of said cover and extending outwardly therefrom cooperating with said second set of catches for securing said second housing into an abutting and locked position with the other side of said cover thereby causing said second open side to be enclosed by said other side of said cover.

6. The timing device of claim 5 in which said first open side is larger than said second open side.

7. The timing device of claim 5 wherein said first and second sets of fastener finger means each comprise a plurality of fastener fingers fixed at one end to said respective sides of said cover and free at the other end thereof, said catches including a plurality of recesses formed in said respective housings about said openings and being adapted to receive and engage said fingers within said recesses.

8. The device of claim 7 in which each fastener finger has a head near said free end thereof, said recesses have means for engaging and twisting said fingers along the length thereof upon entry and maintaining said fingers in said twisted configuration until said housings and said intermediate cover reach the locked position.

9. The device of claim 8 in which said fingers are essentially free of tension when said housings and said intermediate cover are in said locked position.

10. The device of claim 8 in which each of said fingers has a tab intermediate said fixed and free ends, each of said recesses being enclosed along one portion thereof defining an interior and exterior wall, one of said walls having a first projection extending toward and abutting said finger along a surface region of said finger between said tab and said base of said finger when said housings and intermediate cover are in said locked position.

11. The device of claim 10 in which said other of said walls has a second projection with an angled wall providing a guide surface for said finger, said tab camming against said first production upon entry of said finger in each of said recesses and causing said finger to move and twist along said angled wall until said housings and intermediate cover are in said locked position.

12. The device of claim 7 wherein said first set of recesses receiving said first set of fastener finger means includes means for bending said first set of fingers in a first direction upon entry of said fingers into said recesses and for bending a portion of each of said fingers adjacent said free ends thereof in a second direction prior to said housings and said intermediate cover reaching said locked position.

13. The device of claim 12 in which said first set of fingers each has a tab intermediate the fixed and the free ends thereof.

14. The device of claim 13 in which each recess is enclosed along at least a portion thereof defining an interior and exterior wall, one of said walls having a first projection extending toward and abutting said finger along a surface region between said tab and said base of said finger when said intermediate cover and said housing are in said locked position.

15. The device of claim 14 wherein said free end of said finger abuts a second projection extending from the other of said walls when said intermediate cover and said housings are in said locked position.

16. The device of claim 15 wherein said finger is essentially free of tension when said intermediate cover and said housings are in said locked position.

17. The device of claim 15 in which said tab extends toward said exterior wall and said first projection is on said exterior wall.

18. The device of claim 15 in which said tab extends toward said interior wall and said first projection is on said interior wall.

* * * * *